US008861985B2

(12) United States Patent
Iijima

(10) Patent No.: US 8,861,985 B2
(45) Date of Patent: Oct. 14, 2014

(54) COOLING DEVICE AND IMAGE FORMING APPARATUS INCORPORATING SAME

(71) Applicant: Yasuaki Iijima, Kanagawa (JP)

(72) Inventor: Yasuaki Iijima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 73 days.

(21) Appl. No.: 13/756,728

(22) Filed: Feb. 1, 2013

(65) Prior Publication Data

US 2013/0216242 A1 Aug. 22, 2013

(30) Foreign Application Priority Data

Feb. 21, 2012 (JP) ..... 2012-035583
Sep. 27, 2012 (JP) ..... 2012-214653

(51) Int. Cl.
*G03G 15/00* (2006.01)
*G03G 21/20* (2006.01)

(52) U.S. Cl.
CPC ..... *G03G 15/55* (2013.01); *G03G 21/20* (2013.01)
USPC ..... 399/9; 399/94

(58) Field of Classification Search
CPC . G03G 21/20; G03G 21/206; G03G 2221/16; G03G 2221/1645; G03G 15/55
USPC ..... 399/9, 94
See application file for complete search history.

(56) References Cited

U.S. PATENT DOCUMENTS 5,738,049 A * 4/1998 Ninomiya ..... 123/41.15
2007/0089859 A1* 4/2007 Wei ..... 165/80.4
2007/0133170 A1* 6/2007 Yang ..... 361/699
2010/0129107 A1 5/2010 Takehara et al.
2010/0183323 A1 7/2010 Fujiya et al.
2011/0030927 A1 2/2011 Okano et al.
2011/0052247 A1 3/2011 Saitoh et al.
2011/0052248 A1 3/2011 Nishimura et al.
2011/0052249 A1 3/2011 Iijima et al.
2011/0164896 A1 7/2011 Hirasawa et al.
2011/0170895 A1 7/2011 Fujiya et al.
2011/0188880 A1 8/2011 Suzuki et al.
2012/0061057 A1 3/2012 Okano et al.
2012/0070180 A1 3/2012 Iijima et al.
2012/0227927 A1 9/2012 Fujiya et al.
2012/0263491 A1* 10/2012 Fujiya et al. ..... 399/94

FOREIGN PATENT DOCUMENTS

JP 2005-266249 9/2005
JP 2007-024985 2/2007
JP 2009-300852 12/2009

* cited by examiner

*Primary Examiner* — Gregory H Curran
(74) *Attorney, Agent, or Firm* — Harness, Dickey & Pierce, P.L.C.

(57) ABSTRACT

A cooling device for an image forming apparatus includes a heat receiver disposed to contact a heated member; a heat releaser to release heat; a coolant circulation passage connecting the heat receiver and the heat releaser in which a coolant circulates between the heat receiver and the heat releaser; a pump configured to convey and circulate the coolant in the coolant circulation passage; a temperature sensor to detect a temperature of a part of the heated portion of the heated member at which a temperature rises; a cooling fan, included in the heat releaser, configured to change a thermal capacity released from the heat releaser based on the temperature detected by the temperature sensor; and a controller to determine presence or absence of a leakage of the liquid or a pump failure by monitoring a control performed by the cooling fan and the temperature detected by the temperature sensor.

14 Claims, 9 Drawing Sheets

COOLING DEVICE AND IMAGE FORMING APPARATUS INCORPORATING SAME

CROSS-REFERENCE TO RELATED APPLICATIONS

The present application claims priority pursuant to 35 U.S.C. §119 from Japanese patent application numbers 2012-035583 and 2012-214653, filed on Feb. 21, 2012 and Sep. 27, 2012, respectively, the entire disclosures of which are incorporated by reference herein.

BACKGROUND

1. Technical Field

The present invention relates to a cooling device employed in an image forming apparatus such as a printer, a copier, or a facsimile machine, and to an image forming apparatus employing the cooling device.

2. Related Art

An image forming apparatus includes various devices, such as an optical writing device, a fixing device, a developing device, and a driving motor to rotate an image carrier, each of which generates heat. It is known that these included devices increase the temperature inside the image forming apparatus.

Currently, there are many commercially available color image forming apparatuses such as color copiers and color printers available in the marketplace in response to consumer demand. Such color image forming apparatuses are divided into two types: a single-drum type including a single photoreceptor drum as a latent image carrier, and a tandem type including a plurality of photoreceptor drums. The single-drum type image forming apparatus includes a plurality of developing devices disposed around one photoreceptor drum, in which the developing devices are configured to adhere toner onto the photoreceptor drum in a superimposed manner so that a synthesized toner image is formed thereon and the toner image is then transferred to a sheet of paper, thereby recording a color image. The tandem-type image forming apparatus includes a plurality of photoreceptor drums arranged side by side, each including the developing device, in which a monochrome toner image is formed on each photoreceptor and respective monochrome toner images are sequentially transferred onto a sheet of paper, thereby forming a synthesized color image.

Comparing the single-drum type with the tandem type, it can be seen that because the single-drum type includes only one photoreceptor drum, it can reduce cost. However, because multiple image forming operations must be used to form a full-color image with a configuration employing a single photoreceptor, such an apparatus is not suitable for high-speed image formation. The tandem type has a disadvantage in that the apparatus tends to be larger and more expensive, but has an advantage in that it is suitable for high-speed image formation. Accordingly, with the need for the same high productivity for the full-color printer as for the monochrome printer, the tandem type has garnered attention.

FIG. 9 is an explanatory view of a conventional tandem-type image forming apparatus employing a direct transfer method. FIG. 10 is an explanatory view of a conventional tandem-type image forming apparatus employing an indirect transfer method, in which each image forming unit is disposed above the intermediate transfer belt. FIG. 11 is an explanatory view of a conventional tandem-type image forming apparatus employing an intermediate transfer method, in which each image forming unit is disposed below the intermediate transfer belt.

As illustrated in FIG. 9, the tandem-type image forming apparatus may employ a direct transfer method in which a toner image on a photoreceptor 211 of each image forming unit 210 is sequentially transferred to a sheet P conveyed by a sheet conveyance belt 250. Further, as illustrated in FIG. 10, the tandem-type image forming apparatus may employ an indirect transfer method in which a toner image on the photoreceptor 211 of each image forming unit 210 is once transferred sequentially onto an intermediate transfer belt 260, and then the image on the intermediate transfer belt 260 is transferred by a secondary transfer device 270 en bloc to the sheet P. The secondary transfer device 270 as illustrated in FIG. 10 employs a roller method but the secondary transfer may be performed by a transfer conveyance belt method. Further, as illustrated in FIG. 11, the tandem-type image forming apparatus may employ the intermediate transfer belt 260 disposed above the image forming unit 210.

In the tandem-type image forming apparatus employing the indirect transfer method as illustrated in FIG. 10, the interior of the apparatus is packed with structural parts and components and the fixing device 280 is configured to go underneath each image forming unit 210 to realize a compact apparatus size, and therefore, the fixing device 280 tends to be positioned near each image forming unit 210. When the fixing device 280 is disposed near the image forming unit 210, heat from the fixing device 280, which is a heat-generating member, increases the temperature of the image forming unit 210.

The problem of heat rise of each image forming unit being an image forming part has become a common problem for all image forming apparatuses and is not limited to the tandem-type image forming apparatus employing the indirect transfer method due to keen demand for high speed, compact size, and high quality. Given the compact interior layout of an image forming apparatus employing the electrophotographic method, any image forming apparatus employing any method tend to have a greater generated heat amount inside the apparatus due to the demand for higher printing speed, which may cause defects such as toner agglomeration inside each image forming unit.

To cope with the limited interior space of the image forming apparatus, JP-2005-266249-A discloses an air cooling method that cools the very narrow space of the hot conductive member disposed inside the developing device by blowing air on it. However, despite heat accumulation inside the apparatus, toner with a lower melting point has come to be used to achieve higher quality and performance. Thus, it has come to be difficult to sufficiently cool the image forming unit included in an image forming apparatus such as a high-speed color copier by the air cooling method.

JP-2009-30082-A discloses a more effective cooling device using a liquid cooling method in which a heat receiving part, heat radiating part, pump, and a tube connected to each part to circulate a coolant. However, in the cooling device employing the liquid cooling method, the cooling function is damaged if either the liquid leaks or the pump fails. If the cooling function is degraded, toner agglomeration occurs in each of the image forming units as described above. Accordingly, some measure to detect a leak or a pump failure and notify the user that the cooling function is damaged or to terminate the image forming operation is required.

As to the detection of the leakage of the liquid, for example, there may be a method to detect the leakage of the liquid by disposing a sensor to detect the remaining amount of coolant in the circulation path and determine if the leakage of the liquid has occurred or not. Normally, in the cooling device of the liquid cooling method, because the coolant gradually is evaporated from connection parts between each part and piping over time, the difference between the leakage of the liquid and the evaporation due to the elapsed time is difficult to determine only by the change in the remaining amount of the coolant detected by the remaining amount sensor. Thus, leakage is not detected in one case and leakage is detected erroneously in another case.

In addition, many existing pumps do not include a failure sensor and the pump failure cannot be detected.

SUMMARY

The present invention provides an optimal cooling device which can detect the occurrence of the leakage of the liquid or the pump failure more accurately than the conventional devices when the leakage of the liquid occurs or when the pump is damaged.

To achieve the above objective, the cooling device includes a heat receiver disposed to contact a heated member; a heat releaser to release heat; a coolant circulation passage in which a coolant circulates between the heat receiver and the heat releaser; a pump configured to convey and circulate the coolant in the coolant circulation passage; a temperature sensor to detect a temperature of a part of the heated portion of the heated member at which a temperature rises; a cooling fan, includes in the heat releaser, to change a thermal capacity released from the heat releaser based on the temperature detected by the temperature sensor; and a controller to determine presence or absence of a leakage of the liquid or a pump failure by monitoring a control performed by the cooling fan and the temperature detected by the temperature sensor.

These and other objects, features, and advantages of the present invention will become apparent upon consideration of the following description of the preferred embodiments of the present invention when taken in conjunction with the accompanying drawings.

DETAILED DESCRIPTION

Hereinafter, an embodiment of a color copier (simply "a copier") 500 as an image forming apparatus to which the present invention is applied will now be described.

Figure 1:
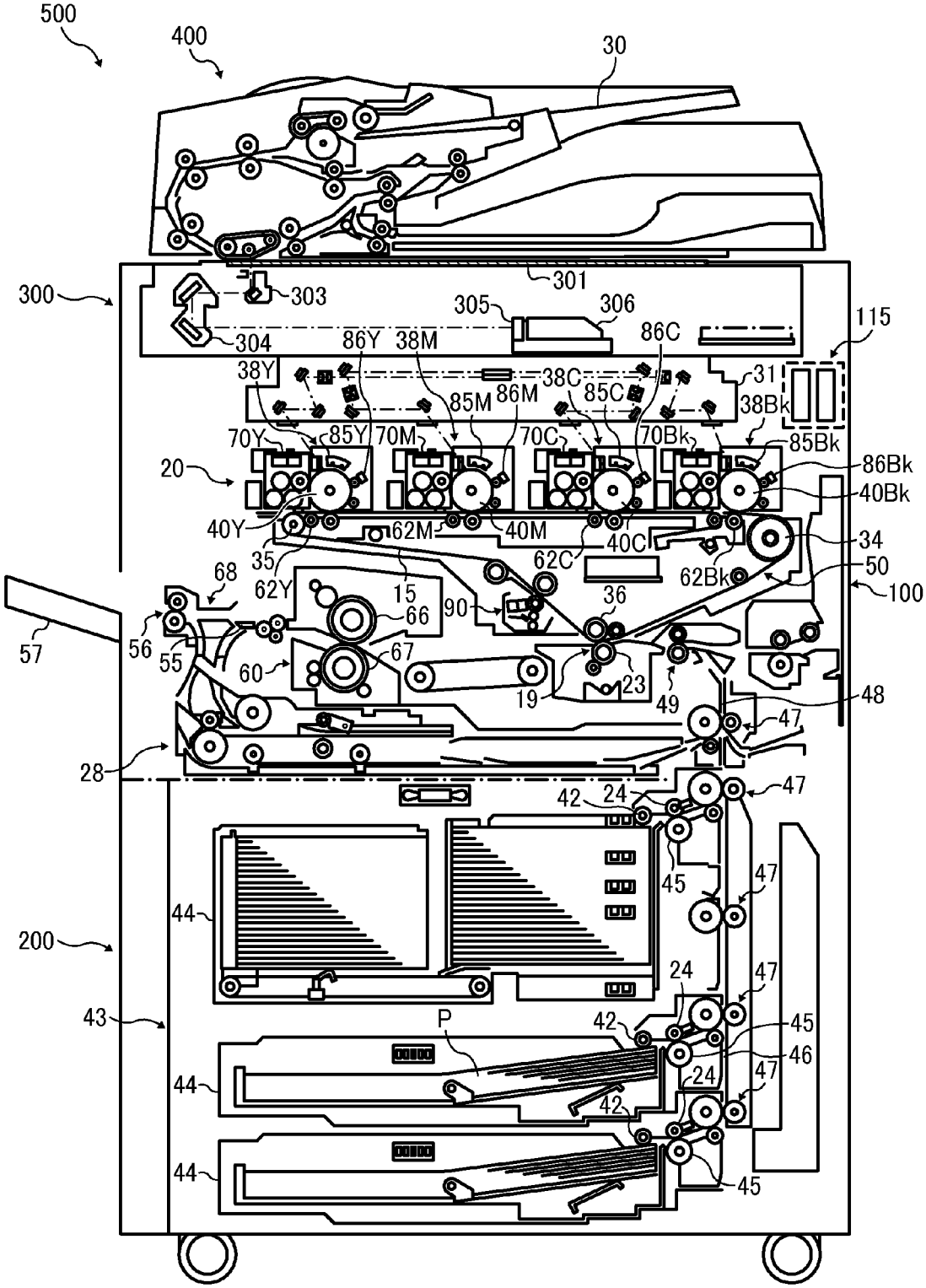
FIG. 1 is a general configuration of a copier according to an embodiment of the present invention.
Figure 2:
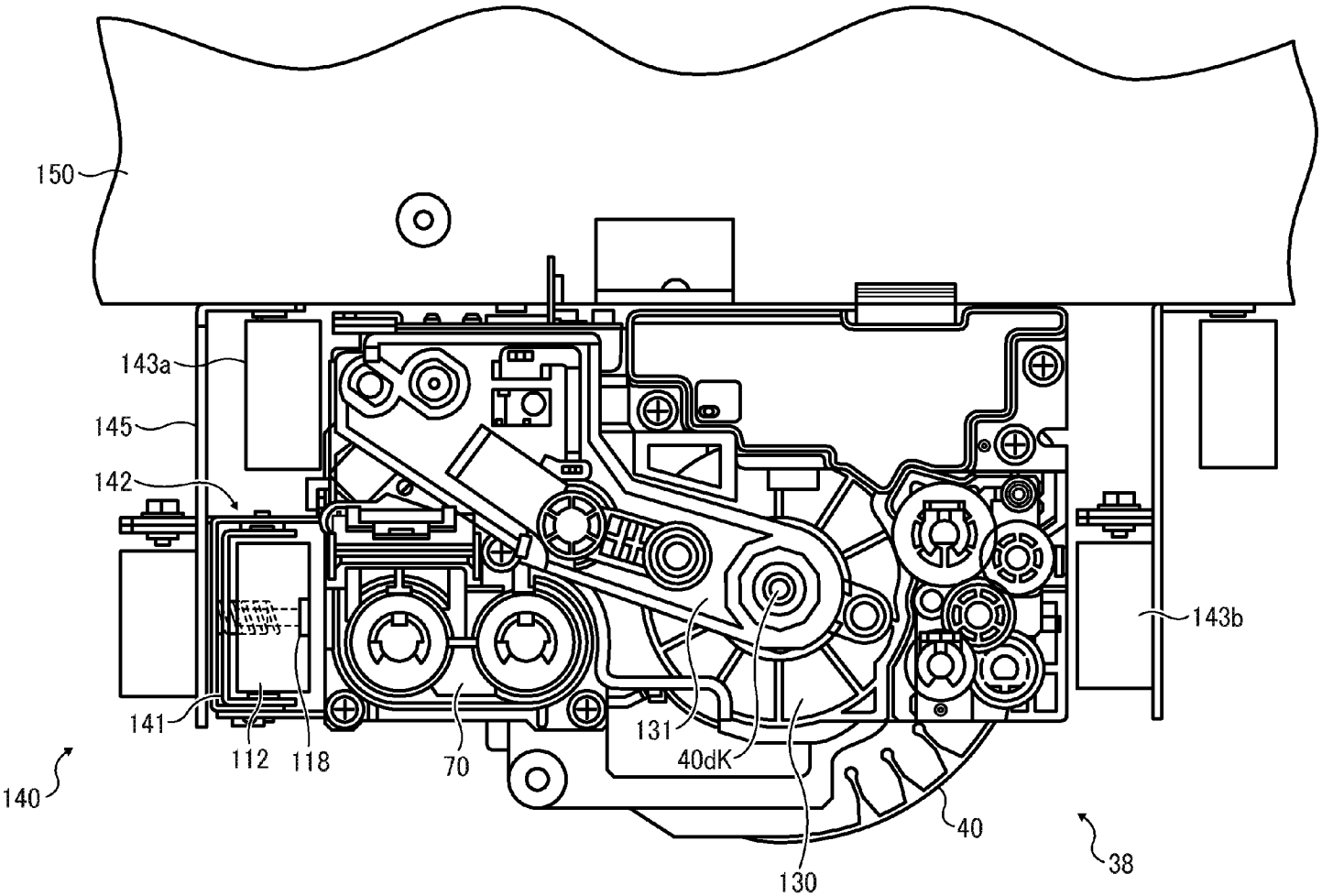
FIG. 2 is a view illustrating a structure of an image forming unit of the copier shown in FIG. 1.
Figure 3A:
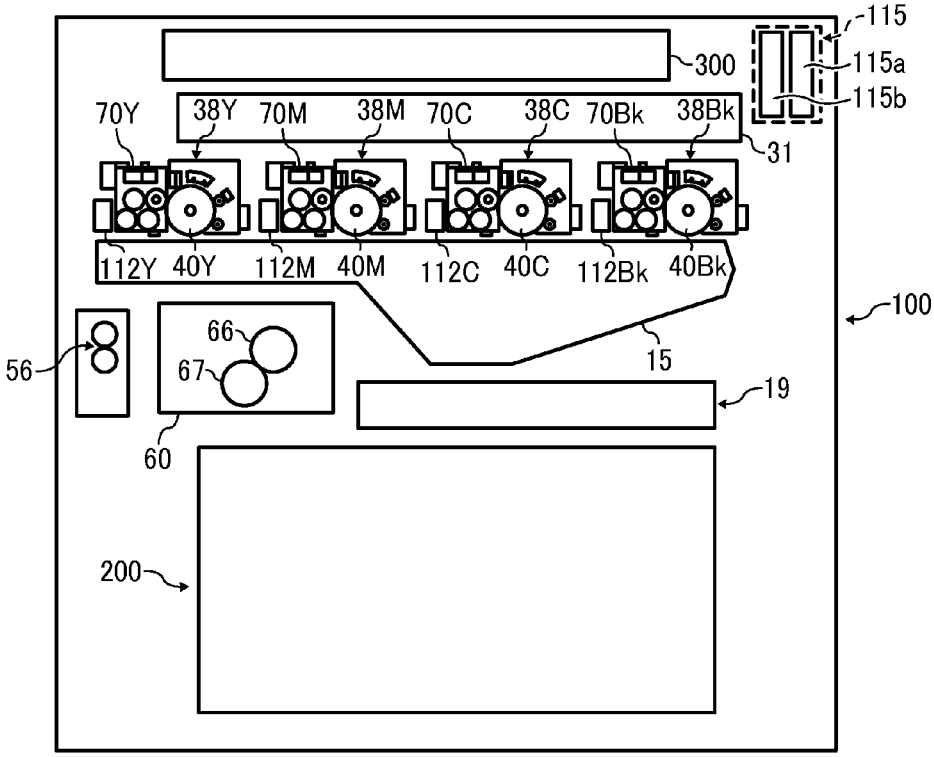
FIG. 3A is a schematic view of a copier seen from front and FIG. 3B is a basic structure of a cooling device of the copier seen from above including a schematic view of circulation passages of a coolant inside the cooling device.
Figure 3B:
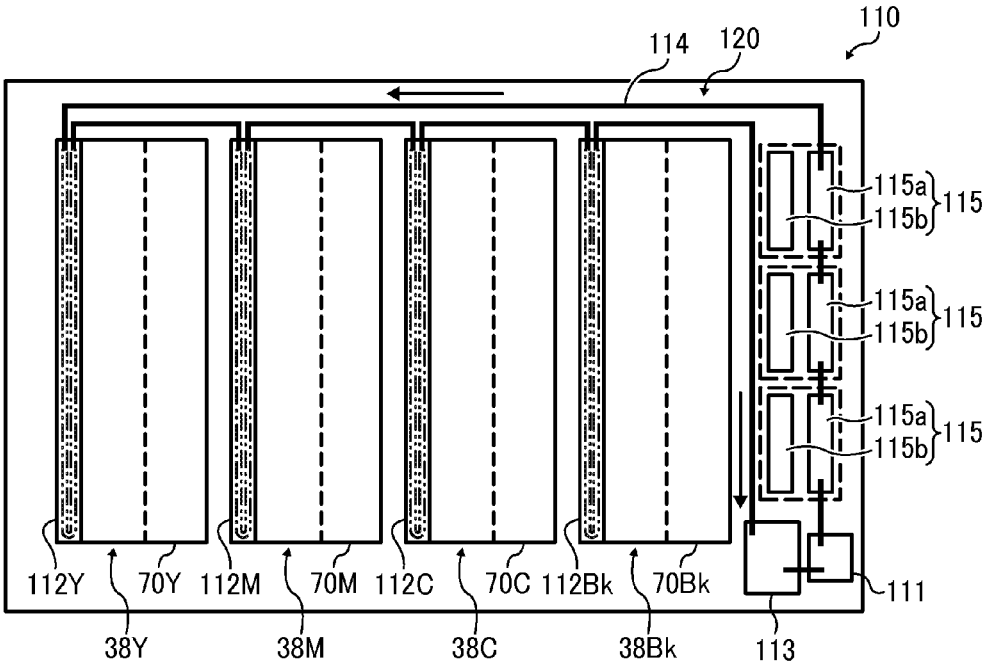
Figure 4:
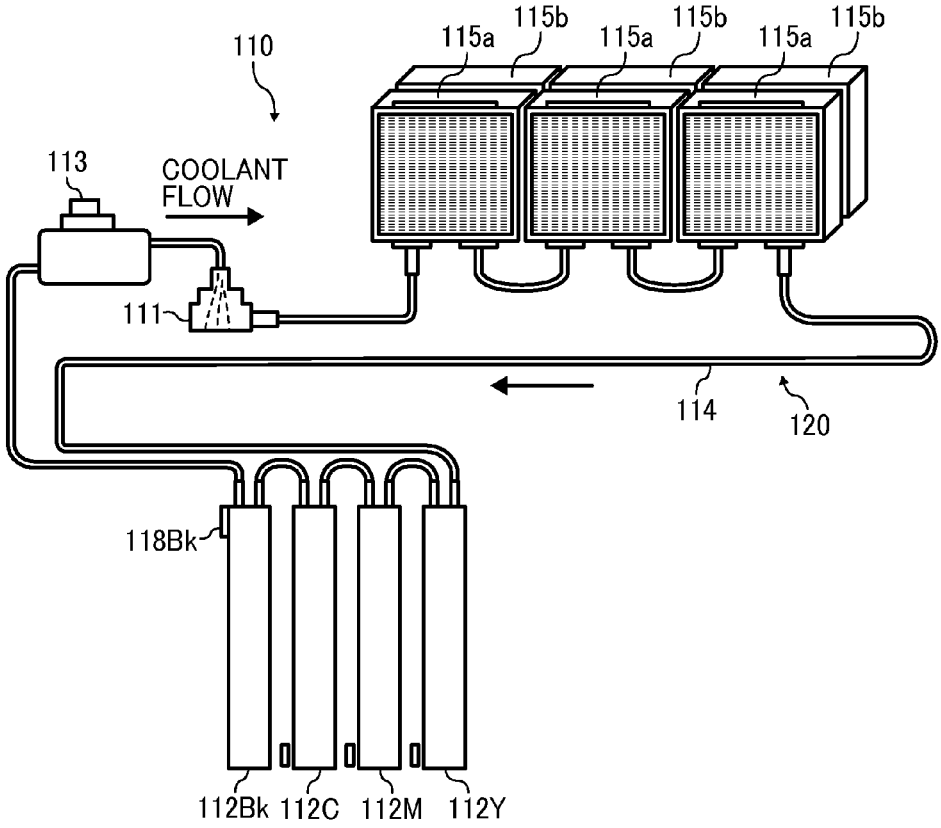
FIG. 4 is an explanatory view of each part of the cooling device.
Figure 5:
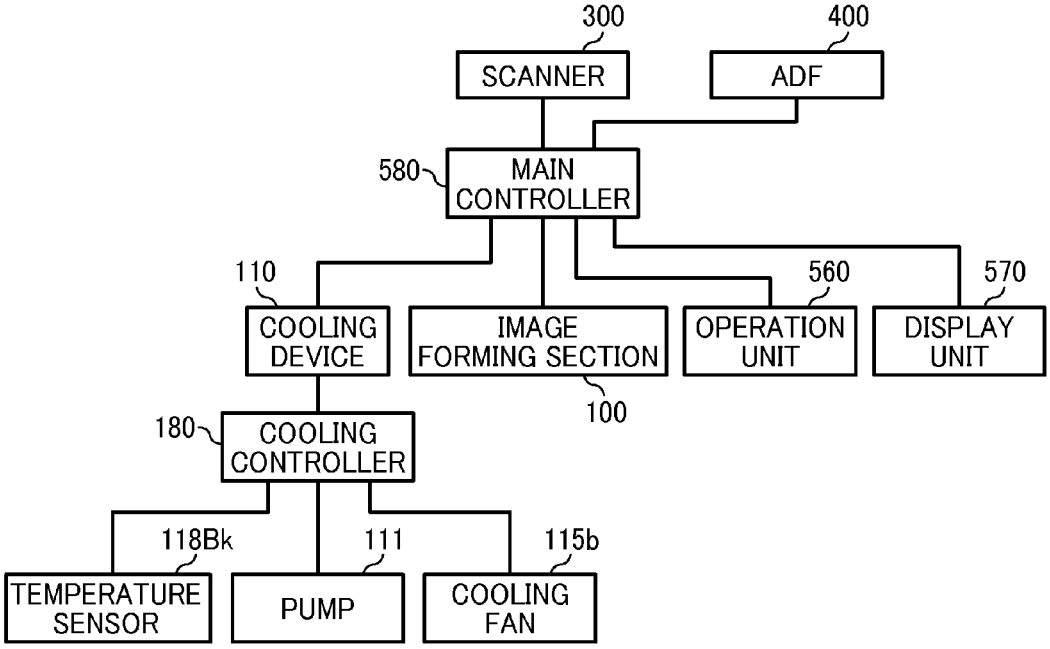
FIG. 5 is a block diagram of a controlling section of the copier and the cooling device.

FIG. 1 is a general configuration of the copier 500 according to an embodiment of the present invention and FIG. 2 is a schematic view of an image forming unit 38. FIG. 3A is a schematic view of the copier 500 seen from front and FIG. 3B is a basic structure of a cooling device 110 of the copier 500 seen from above including a schematic view of circulation passages of a coolant inside the cooling device 110. FIG. 4 is an explanatory view of each part in the cooling device 110 and FIG. 5 is an exemplary block diagram of a controlling section of the copier and the cooling device.

First, a basic structure of the copier 500 will now be described. As illustrated in FIG. 1, this copier 500 mainly includes an image forming section 100; a sheet feed unit 200; a scanner 300; and an automatic document feeder (ADF) 400. The image forming section 100 is a main part of the copier to form an image and is disposed on the sheet feed unit 200. The scanner 300 is disposed on the image forming section 100. The ADF 400 is disposed on the scanner 300.

The scanner 300 includes a first carrier 303 on which a light source for illuminating an original and mirrors are mounted, a second carrier 304 on which a plurality of reflection minors are mounted, and a contact glass 301 on which the original to be read is placed. Accompanied by a reciprocal movement of the first and second carriers 303 and 304, the original, not shown, placed on the contact glass 301 is read while being scanned. The scanning light emitted from the second carrier 304 is focused via a focusing lens 305 on an imaging surface of a reading sensor 306 disposed behind the focusing lens 305, and is read by the reading sensor 306 as an image signal.

The image forming section 100 includes photoreceptor drums 40Y, 40M, 40C, and 40Bk, as latent image carriers, corresponding to toner of each color of yellow (Y), magenta (M), cyan (C), and black (Bk), respectively. Around each photoreceptor drum 40, means to perform electrophotographic processes such as a developing device 70, a charger 85, and a cleaning unit 86 are disposed, so that each image formation unit 38Y, 38M, 38C, or 38Bk is constructed. Each image formation unit 38 is detachably disposed to the copier main body and is replaceable as a consumable part at once. Four image formation units 38 are disposed in parallel to form a tandem-type image forming unit 20. Each image formation unit 38 handles different color of toner but is configured identical to each other in its structure and operation. Therefore, the suffixes of Y, M, C, and Bk are appropriately omitted in the following description.

The developing device 70 of each image formation unit 38 handles a developer containing a corresponding color toner among four colors of toner. The developing device 70 includes a developing roller 71 as a developer carrier to carry and convey the developer so that the developing roller 71 renders a latent image on the photoreceptor drum 40 visible at a position opposite the photoreceptor drum 40.

In addition, as illustrated in FIG. 2, each image formation unit 38 includes contracting rails 143*a* and 143*b*, such as Accuride® (a trade name of Accuride Japan Co., Ltd.) disposed on the apparatus main body. The image formation unit 38 mounted on these rails 143*a* and 143*b* and a drum axis 40*d*K is pushed back toward inside the copier so that the image formation unit 38 is mounted to the main body of the copier. The developing device 70 of each image formation unit 38 is provided with a separation device 140. The separation device 140 allows each heat receiver 112 of a cooling device 110, which will be described later, to be contacted to or separated from the developing device 70. The developing device 70 is to be cooled by the cooling device 110. The separation device 140 includes a retention member 141 to retain the heat receiver 112 and a support member 142 to support the retention member 141 so as to be contacted to or separated from the developing device 70.

The heat receiver 112 is pressed against a side wall of the developing device 70 by an elastic member, not shown, provided to the retention member 141. The support member 142 is fixed to a fixed member 145 to which the rail 143*a* on the right side in the figure is mounted. The fixed member 145 is fixed to a separation plate 150 to separate a writing area in which an exposure device 31, which will be described later is disposed from the tandem-type image forming unit 20. Then, the retention member 141 faces three surfaces of the heat receiver 112, that is, an opposite surface of the contacted surface of the heat receiver 112, and upper and lower surfaces of the heat receiver 112 so as to cover the heat receiver 112. Because the retention member 141 covers the heat receiver 112, an infrared light from a fixing device 60 which will be described later and from other parts can be shielded and the thermal effect from other than the developing device 70 exerted on the heat receiver 112 can be prevented. Because the thermal effect from other than the developing device 70 to heat the heat receiver 112 is prevented, the developing device 70 can be effectively cooled.

The exposure device 31 exposes the photoreceptor drum 40 with a laser beam or LED light based on the image information to form a latent image on the photoreceptor drum 40. The exposure device 31 is disposed above the tandem-type image forming unit 20.

In addition, an endless intermediate transfer belt 15 is disposed below the photoreceptor drum 40 of the tandem-type image forming unit 20 opposing to the photoreceptor drum 40. The intermediate transfer belt 15 is supported by a support roller 34, another support roller 35, and a secondary transfer backup roller 36. At an adjacent position opposed to the photoreceptor drum 40 via the intermediate transfer belt 15, a primary transfer device 62 configured to transfer each color toner image formed on each photoreceptor drum 40 to the intermediate transfer belt 15 is disposed.

A secondary transfer device 19 is configured to transfer, en bloc, a toner image formed in a superimposed manner on the surface of the intermediate transfer belt 15 to a sheet P conveyed from a sheet feed cassette 44 of the sheet feed unit 200. The secondary transfer device 19 is disposed below the intermediate transfer belt 15. The secondary transfer device 19 includes a secondary transfer roller 23 and a separation mechanism, not shown, configured to support the secondary transfer roller 23 to be contacted to and separated from the intermediate transfer belt 15. The secondary transfer device 19 presses the secondary transfer roller 23 against the secondary transfer backup roller 36 via the intermediate transfer belt 15 so that the toner image formed on the intermediate transfer belt 15 is transferred to the sheet P.

A belt cleaning unit 90 is disposed to remove residual toner remaining on the surface of the intermediate transfer belt 15. The belt cleaning unit 90 causes a cleaning blade formed of a fur brush or urethane rubber to contact the intermediate transfer belt 15 so that any residual toner deposited on the intermediate transfer belt 15 after a secondary transferring process is scraped off the belt.

The fixing device 60 configured to fix the transferred image onto the sheet P is disposed adjacent to the secondary transfer device 19. The fixing device 60 mainly includes a heat roller 66 in which a built-in heater is mounted and a pressure roller 67 to be pressed against the heat roller 66.

Below the secondary transfer device 19 and the fixing device 60, a reverse unit 28 to reverse the sheet P is disposed. The reverse unit 28 reverses the sheet P to form an image on both sides of the sheet P.

Next, an operation of the thus-configured image forming apparatus will now be described. As illustrated in FIG. 1, an original is set on a platen 30 of the ADF 400 or placed on the contact glass 301 of the scanner 300 after opening the ADF 400, and the ADF 400 is closed. In this state, assume that a start switch, not shown, on a control panel is pressed. When the original is set on the ADF 400, the original is first conveyed onto the contact glass 301 and the scanner 300 is driven to start. When the original is set on the contact glass 301, the scanner 300 is caused to start promptly. Then, in both cases, the first carrier 303 and the second carrier 304 of the scanner 300 start to be driven. The first carrier 303 emits light from its light source, receives reflected light from the original surface, and reflects the received light to the second carrier 304. The second carrier 304 further reflects the received light via the mirror toward a focusing lens 305 to be incident to a reading sensor 306 which reads the content of the original.

Pressing the start switch on the control panel also causes a driving motor, not shown, to be driven so that at least one of the support rollers 34 and 35, and the secondary transfer backup roller 36 is driven to rotate and other two support rollers are driven to rotate accompanies by the rotation of the at least one roller. As a result, the intermediate transfer belt 15 is rotated. At the same time, the charger 85 in each image formation unit 38 uniformly charges the photoreceptor drum 40. Subsequently, the exposure device 31 emits writing beams such as laser light from an LED based on the reading content read by the scanner 300 onto the charged surface of each photoreceptor drum 40, thereby forming an electrostatic latent image on each photoreceptor drum 40. Toner is supplied from the developing device 70 to the photoreceptor drum 40 on which the electrostatic latent image is formed so that the electrostatic latent image is rendered visible and a monochrome image of each color of yellow (Y), magenta (M), cyan (C), and black (Bk) is formed on each corresponding photoreceptor drum 40. The primary transfer device 62 primarily transfers the monochrome image sequentially onto the intermediate transfer belt 15 so as to superimpose the monochrome images one after another, and thus a synthesized color image is formed on the intermediate transfer belt 15. Each surface of the photoreceptor drum 40 on which the residual toner after an image transfer remains is cleaned by the cleaning unit 86, is discharged by the discharger, not shown, and is then ready for a next image forming operation.

Further, pressing on the start switch on the control panel causes one of the sheet feed roller 42 of the sheet feed unit 200 to be selected and rotated so that the sheet P is sequentially fed from one of the sheet feed cassettes 44 provided in a multi-storied paper bank 43, is separated one by one by a separation roller 45, and is inserted into a sheet conveyance path 46. The sheet P is then conveyed by the conveyance roller pair 47 to be led into the conveyance path 48 inside the image forming section 100 and stops by contacting a registration roller pair 49. Next, the registration roller pair 49 is rotated in sync with a synthesized color image formed on the intermediate transfer belt 15 so that the sheet P is sent between the intermediate transfer belt 15 and the secondary transfer device 19 in which the color image on the intermediate transfer belt 15 is transferred by the secondary transfer device 19 and the color image is transferred onto the sheet P.

The sheet P on which the unfixed toner image is carried having passed the secondary transfer roller 23 is conveyed to the fixing device 60 and the image transferred onto the sheet P is fixed thereon with heat and pressure at the fixing device 60. The sheet P after image fixation is switched by a switching claw 55, is ejected outside by an ejection roller pair 56, and is stacked on a sheet ejection tray 57. Alternatively, after its direction is switched by the switching claw 55 to be introduced to the reverse unit 28, in which the sheet P is reversed and is introduced again to the transfer position and an image is recorded on its back side. Then, the sheet P is ejected onto the sheet ejection tray 57 via the ejection roller pair 56. Herein, the residual toner remaining on the intermediate transfer belt 15 after transferring operation is removed by the belt cleaning unit 90, and the cleaned surface of the intermediate transfer belt 15 becomes ready for a next image formation in the tandem-type image forming unit 20.

When such an image forming operation continues for a long period of time, the temperature of the image formation unit 38 increases due to the heat from the photoreceptor drum 40 and the developing roller 71 itself and due to the heat from the fixing device 60. In such a case, the temperature inside the developing device 70 of the image formation unit 38 also increases and the toner inside the developing device 70 is melted and then agglomerated. As a result, the formed image may be defective and otherwise the agglomerated toner may cause the apparatus to be stopped or damaged.

Obviously, the temperature inside the developing device 70 needs to remain below the temperature for the toner to be melted. In the present embodiment, a cooling device 110 which is a cooling system to prevent a temperature rise inside the developing device 70 is provided. Specifically, the heat receiver 112 or a cooling jacket in which a coolant flows is contacted to the side surface of the developing device 70 so as to prevent the temperature rise inside the developing device 70.

As illustrated in FIGS. 3A and 3B, the cooling device 110 includes a heat receiver 112, a pipe 114, a heat releaser 115 formed of a radiator 115*a* and a cooling fan 115*b*, a pump 111, and a tank 113. Four heat receivers or cooling jackets 112Y, 112M, 112C, and 112Bk each are so disposed as to closely contact a side wall being a heated portion of the developing devices 70Y, 70M, 70C, and 70Bk, respectively. The coolant circulating inside each of the heat receivers 112 absorbs heat from the developing device 70. Specifically, four heat receivers 112Y, 112M, 112C, and 112Bk are so disposed as to contact each side surface of the developing device 70Y, 70M, 70C, and 70Bk which are temperature rising parts, and the coolant circulating inside each heat receiver 112 absorbs heat from each developing device 70.

In addition, the pipe 114 circularly connects the heat receivers 112Y, 112M, 112C, and 112Bk, the tank 113, the pump 111, and the radiator 115*a* so as to form a coolant circulation passage 120, in which the coolant circulates along the passage 120 in a direction as indicated by arrows in FIG. 3B. Specifically, the pipe 114 serves as a coolant circulation passage 120 in which the coolant circulates between the four heat receivers 112Y, 112M, 112C, and 112Bk and the heat releaser 115 formed of the radiator 115*a* and the cooling fan 115*b*.

Herein, FIG. 4 shows the structure of the cooling device 110 alone. As illustrated in FIG. 4, because the cooling device 110 is connected via the pipe 114 to each heat receiver 112, the tank 113, the pump 111, and each radiator 115*a*, the cooling device 110 is fixedly provided to the copier apparatus and is ready for mounting each image formation unit 38 in the operation position. Further, the heat releaser 115 introduces air from outside via the cooling fan 115*b* and cools the radiator 115*a* by blowing air onto its fins. Herein, the radiator 115*a* may be positioned at whichever side of an air inlet or an air outlet between the cooling fan 115*b* and the radiator 115*a*.

The pump 111 serves to circulate the coolant inside the coolant circulation passage 120. Specifically, the pump 111 functions as a conveying means to circulate the coolant inside the coolant circulation passage 120 between the heat releaser 115 and each heat receiver 112. In addition, the tank 113 stores the coolant inside thereof and is used to fill the coolant circulation passage 120 with the coolant.

As illustrated in FIG. 5, the copier 500 according to the present embodiment includes a main controller 580 to control operation of each of the scanner 300, the ADF 400, the image forming section 100, the operation unit 560, the display unit 570, and the cooling device 110.

Herein, the cooling device 110 according to the present embodiment includes a cooling controller 180 to control the cooling fan 115*b*, the pump 111, and a temperature sensor 118Bk. However, the present invention is not limited to this structure. For example, a controller may be provided to each of the cooling fan 115*b* and the pump 111, or alternatively, the cooling controller 180 may be disposed to the main controller 580 so that the main controller 580 may commonly control the cooling device 110.

Next, a plurality of embodiments will be represented to explain the control performed by the cooling controller 180 of the cooling device 110 when determining the leakage or the pump failure and measures when the leakage or the pump failure has been detected.

Figure 6:
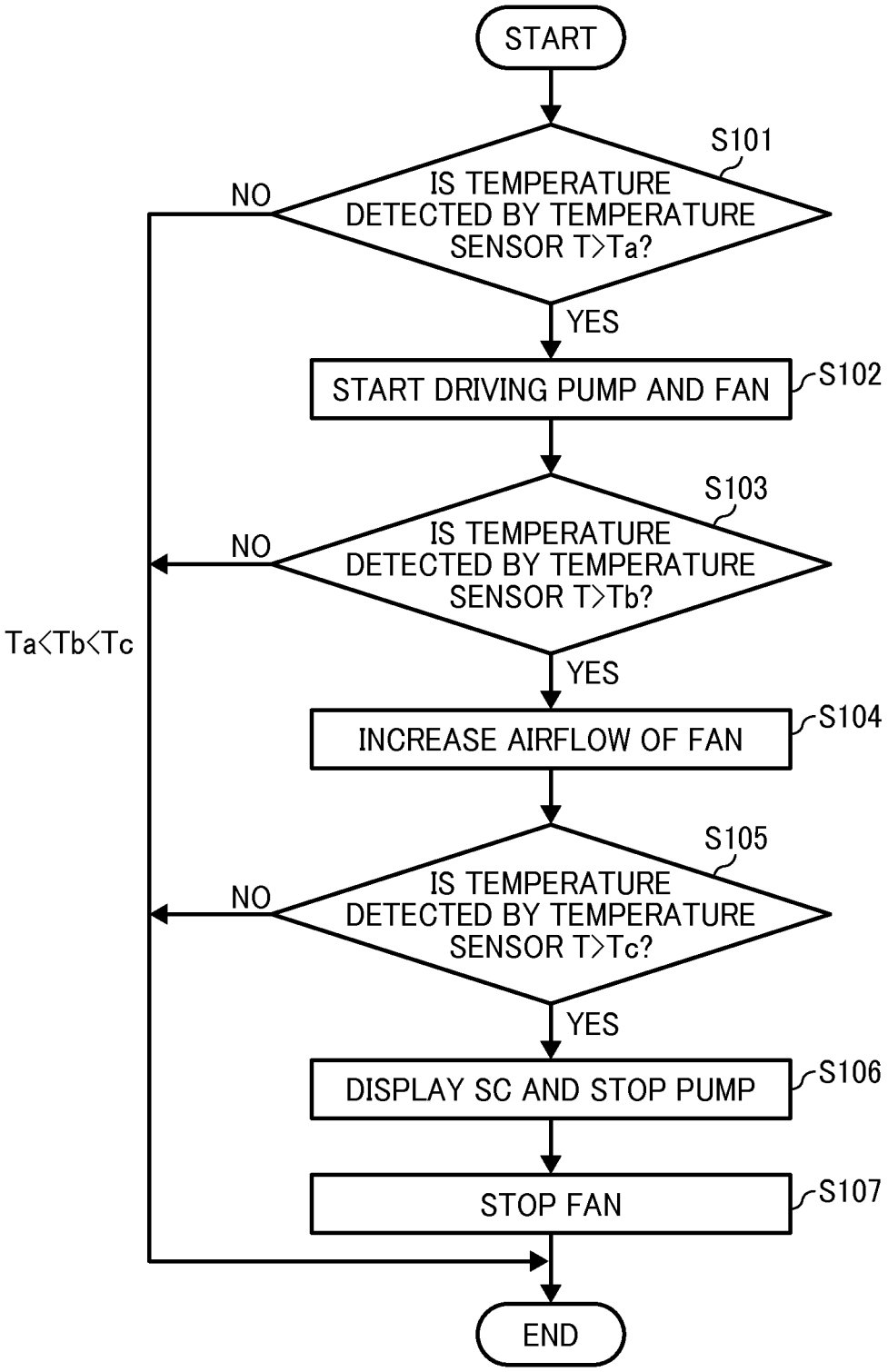
FIG. 6 is a flowchart depicting a control process executed by a cooling controller in determining presence or absence of a leakage or a pump failure according to a first embodiment of the present invention.

FIG. 6 is a flowchart depicting a control process executed by the cooling controller 180 in determining presence or absence of a leakage or a pump failure according to a first embodiment of the present invention.

It is thought that the temperature of a portion where the activation ratio is highest and which is most heated becomes highest, and therefore, the heat receiver 112Bk closely contacted to the side wall of the developing device 70 which is the part that heats up the most is provided with the temperature sensor 118Bk as illustrated in FIG. 4. The temperature sensor 118Bk does not receive any influence from the temperature of the coolant flowing inside the heat receiver 112Bk and is protected by a heat insulating material, not shown, at a position avoiding the pipe inside the heat receiver 112Bk so that the temperature of a side surface where the temperature increases, of the developing device 70Bk can be detected. Then, the heat receiver 112Bk is pressed against the side surface of the developing device 70Bk and the temperature of a portion where the temperature increases, of the developing device 70Bk can be detected. Further, as a cooling fan to be disposed at the heat releaser 115, the cooling fan 115*b* is disposed to control the thermal capacity released from the heat releaser 115 to be changed based on the detected temperature of the temperature sensor 118Bk. Then, the cooling fan 115*b* of the heat releaser 115 is controlled based on the temperature detected by the temperature sensor 118Bk, and the cooling controller 180 which determines whether or not the leakage or the pump failure exists detects the leakage or the pump failure.

According to a flowchart as shown in FIG. 6, the control performed by the cooling controller 180 that determines presence or absence of the leakage or the pump failure is as follows. As illustrated in FIG. 6, a temperature T (hereinafter, "the detected temperature T") detected by the temperature sensor 118Bk exceeds a temperature Ta for starting cooling (Yes in step S101), the cooling fan 115*b* of each heat releaser 115 is controlled based on the temperature Ta so as to cause the cooling fan 115*b* to start operation by an operation mode with a predetermined speed of the fan. In addition, driving of the pump 111 also starts (step S102). Then, when the detected temperature T exceeds a target temperature Tb (Ta<Tb) (Yes in step S103), the operation is switched to an operation mode to increase the air amount by increasing the speed of the cooling fan 115*b* so that the thermal capacity to be released from each heat releaser 115 is increased (step S104).

Herein, a design temperature Tc (Ta<Tb<Tc) at which occurrence of the defective image due to toner agglomeration is previously set according to the structure of the developing device 70 or the toner used. Then, a lower temperature having a predetermined allowance with respect to the design temperature Tc is defined as the target temperature Tb. If the detected temperature T is beyond the design temperature Tc, a possibility of the occurrence of defective image becomes high, the normal image formation is prevented, and the image forming apparatus itself does not function normally. Accordingly, the cooling device 110 according to an embodiment of the present invention is controlled to be lower than the target temperature Tb with a predetermined allowance with the design temperature Tc. Then, when the detected temperature T exceeds the target temperature Tb, an operation mode is switched to the operation mode to change the speed of the fan so that a thermal capacity to reduce the detected temperature T lower than the design temperature Tc is released from each heat releaser 115 if any leakage or pump failure does not exist, and the speed of each cooling fan 115*b* is increased. As above, by controlling each cooling fan 115*b*, if the leakage or the pump failure does not exist, the thermal capacity to reduce the detected temperature T below the design temperature Tc is released from each heat releaser 115 and the design temperature becomes below the design temperature Tc.

However, if any leakage of the coolant from joint portions with other parts such as pipes 114, a tubing portion inside the circulation passage 120, occurs or there is any failure in the pump 111, the conveyance of the heat by the coolant as a moving fluid cannot be done. As a result, if the leakage or the pump failure exists, when the detected temperature T exceeds the target temperature Tb (Yes in step S103), a control to increase the airflow from each cooling fan 115*b* is performed so that the detected temperature T becomes below the design temperature Tc if there is no leakage or the pump failure (S 104), a desired thermal capacity cannot be released from each heat releaser 115. As a result, a phenomenon such that the detected temperature T of the temperature sensor does not decrease to less than the design temperature Tc occurs. That is, a phenomenon in which the detected temperature T exceeds the design temperature Tc occurs. Then, focusing on such a phenomenon, by monitoring the control of each cooling fan 115*b* and the detected temperature T, the cooling controller 180 is configured to determine whether or not the leakage or the pump failure occurs.

If there is no leakage or pump failure, each cooling fan 115*b* is controlled so that the detected temperature T becomes below the design temperature Tc, and if the detected temperature T becomes below the design temperature Tc, it is determined there is no leakage or failure of the pump 111 (NO in step S105).

On the other hand, if the detected temperature does not decrease to below the design temperature Tc, it is determined that the leakage or the failure of the pump 111 exists (Yes in step S105), and following processing is to be performed.

That is, a communication with the main controller 560 of the copier 500 is performed, so that an error code indicating that "there is a possibility that the pump failure or the leakage occurs" and a message (SC) prompting the user to contact a service center for repair (hereinafter, "SC prompt") are displayed on the display 570 of the copier 500, and the pump 111 of the cooling device 110 is stopped (S 106). In addition, the cooling fan 115*b* of each heat releaser 115 is also stopped (S107). Further, the main controller 560 of the copier 500 stops the successive image forming operation when the cooling device 110 is stopped as described above.

An example of an actual control performed by the cooling controller 180 of the cooling device 110 is as follows. Herein, for the purposes of this example, the cooling start temperature Ta, the target temperature Tb, and the design temperature Tc are respectively set as 25 degrees C., 35 degrees C., and 45 degrees C. In addition, as to the following examples of control, FIG. 6 is used for explanation.

When the detected temperature T is below 25 degrees C. which is equal to the cooling start temperature Ta (NO in step S101), the process moves from an end (E) to a start (S) in a state where both the pump 111 and the cooling fan 115*b* are stopped and a determination flow is repeated again. On the other hand, when the detected temperature T exceeds 25 degrees C. (Yes in step S101), an operation mode is switched to the mode in which the conveyance capacity of the pump 111 is 0.5 L/min and the operation is started as well as the speed of the cooling fan 115*b* is 2,000 rpm (in step S102).

After the pump 111 and the cooling fan 115*b* have started operation in (S 102), if the detected temperature T is below 35 degrees C. which is equal to the target temperature Tb (NO in step S103), a process moves from the end (E) to the start (S) and the determination flow is repeated again. On the other hand, when the detected temperature T is increased to exceed the target temperature Tb as being 35 degrees C. (Yes in step S103), an operation mode is switched to the operation mode in which the speed of the cooling fan 115*b* is 3,000 rpm being the speed so that each heat releaser 115 releases a thermal capacity allowing the detected temperature T to be decreased to below 45 degrees C. being the design temperature Tc if no leakage or pump failure exists (in step S104).

After the operation mode is switched to the operation mode in which the rotation number of the fan of the cooling fan 115*b* is 3,000 rpm (S104), when the detected temperature T becomes below the design temperature Tc which is equal to 45 degrees C. (NO in step S105), the operation moves from the end (E) to the start (S) and the determination flow is repeated again. On the other hand, if the detected temperature T does not decrease to below the design temperature Tc which is equal to 45 degrees C., it is determined that the leakage or the failure of the pump 111 exists (Yes in step S105) and the following process is to be performed. That is, a communication with the main controller 560 of the copier 500 is performed, the error code and the message (SC) prompting the user to contact the service center for repair are displayed on the display 570 of the copier 500, and the pump 111 of the cooling device 110 is stopped (S 106). In addition, the cooling fan 115*b* of each heat releaser 115 is also stopped (S107). Further, the main controller 560 of the copier 500 stops the successive image forming operation when the cooling device 110 is stopped as described above. When the detected temperature T is below 25 degrees C. which is equal to the cooling start temperature Ta when the determination flow is to be repeated again after moving from End (E) to Start (S), an operation is switched to a state in which both the pump 111 and the cooling fan 115*b* are stopped.

As described above, the cooling device 110 according to the present embodiment includes the cooling controller 180 which determines whether or not the leakage or the pump failure exists by monitoring the control of the cooling fan 115*b* and the detected temperature T detected by the temperature sensor 118Bk. Provision of such a cooling controller 180 enables to determine presence or absence of the leakage or the pump failure, even when it is difficult to determine whether the pump failure occurs or not due to lack of the failure detector disposed to the pump itself or whether the leakage occurs or not by the remaining amount sensor. Accordingly, the leakage or the pump failure can be detected more accurately compared to the conventional devices. In addition, provision of the cooling controller 180 also enables to communicate with the main controller 560 of the copier 500 so that the error code and the message (SC) prompting the user to contact the service center for repair is displayed on the display 570 of the copier 500, the pump 111 of the cooling device 110 is stopped, and the successive image forming operation is stopped.

Advantageously, the present invention provides the cooling device 110 which can detect the occurrence of the leakage or the pump failure more accurately than the conventional devices when the leakage of the liquid occurs or the pump has failed. Further advantageously, the cooling device 110 of the present invention enables the copier 500 to be performed appropriately even when the leakage occurs or the pump has failed. Thus, the provision of the cooling device 110 provides the copier 500 capable of being operated appropriately even when the leakage occurs or the pump has failed.

In addition, because the control of the cooling fan 115*b* relates to driving or stopping the cooling fan 115*b* or switching the speed of the fan of the cooling fan 115*b*, the control performed by the cooling controller 180 to determine whether or not the leakage or the pump failure exists is streamlined.

When it is determined that the leakage or the pump failure occurs, a case in which the cooling device 110 is stopped and the successive image forming operation is stopped has been described heretofore. However, the present invention is not limited only to this. For example, it may be configured such that after the cooling device 110 is stopped and the successive image forming operation is stopped, and the image forming operation restarts in a tentative mode when the detected temperature T is decreased to below the cooling start temperature Ta or the target temperature Tb. If the image forming operation is restarted tentatively as above, in addition to the "Error Code" and the message prompting the user to contact a service center for repair (hereinafter, "SC prompt"), a message for "Tentative operation" is displayed on the display 570 of the copier 500. Then, upon the detected temperature T reaching the target temperature Tb or the design temperature Tc, the image forming operation is again stopped. The configuration as described above may improve convenience for the user.

Figure 7:
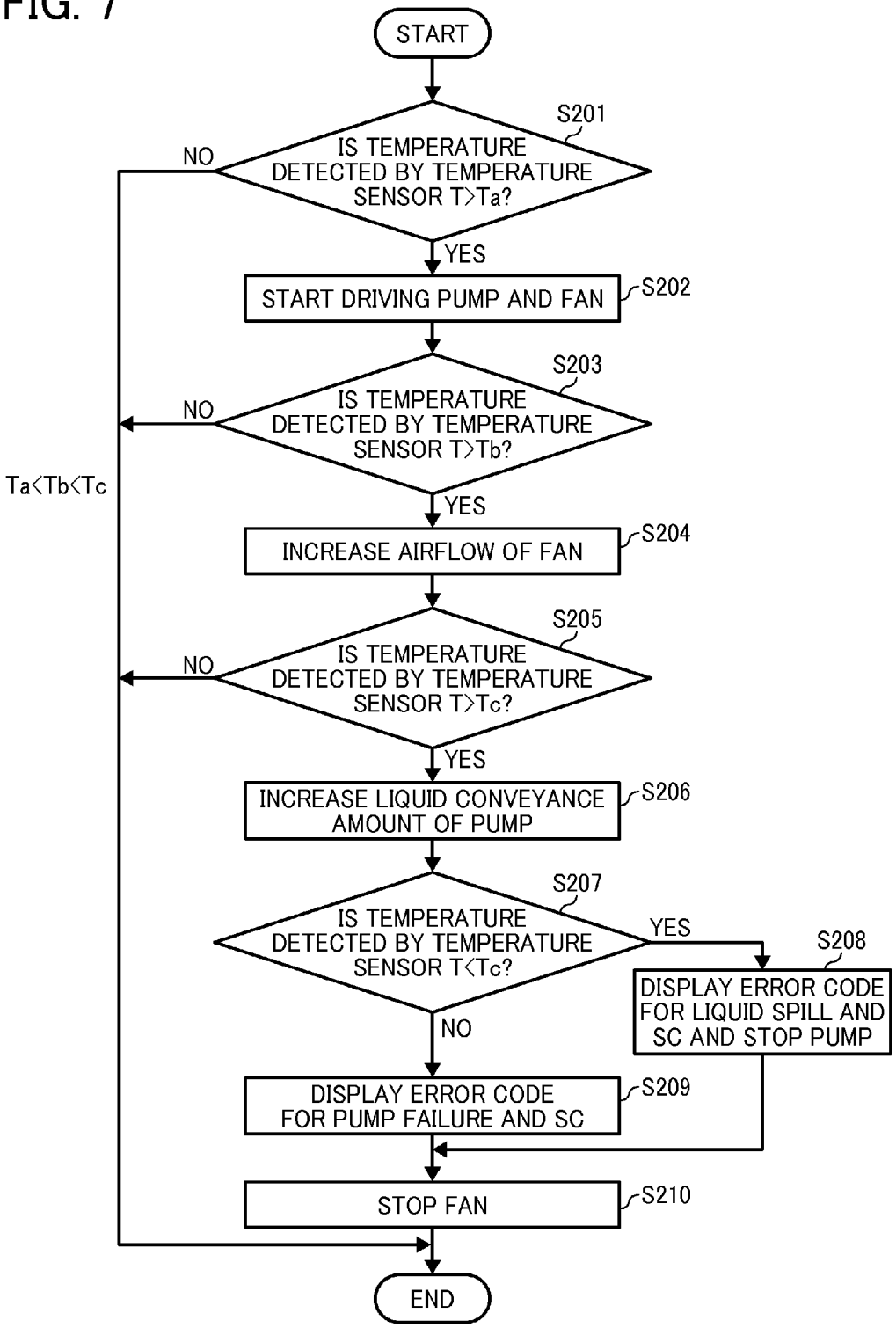
FIG. 7 is a flowchart depicting a control process executed by a cooling controller in determining presence or absence of a leakage or a pump failure according to a second embodiment of the present invention.

Operation of a second embodiment of the cooling device 110 will now be described with reference to FIG. 7. A redundant explanation of the structure and operation of the cooling device similar to the first embodiment will be appropriately omitted in the following description. FIG. 7 is a flowchart depicting a control process executed by the cooling controller 180 in determining presence or absence of a leakage or a pump failure according to the second embodiment of the present invention.

The control performed by the cooling controller 180 in determining presence or absence of the leakage or the pump failure according to the second embodiment is different from the first embodiment in that the control by the cooling controller 180 enables to determine whichever of the leakage and the pump failure occurs and that processing after the determination is different. Accordingly, the structure similar to the first embodiment will be appropriately omitted in the following description.

Similar to the first embodiment, the cooling device 110 according to the second embodiment includes the heat receiver 112Bk closely contacted to the side wall of the developing device 70Bk which is the part that heats up the most and the temperature sensor 118Bk disposed at the heat receiver 112Bk as illustrated in FIG. 4. In addition, as a pump to convey the coolant to be circulated in the coolant circulation passage 120, the pump 111 capable of changing its conveyance capacity of the coolant is disposed. Then, the cooling fan 115*b* of the heat releaser 115 is controlled based on the temperature detected by the temperature sensor 118Bk, and the cooling controller 180 which determines whether or not the leakage or the pump failure exists detects the leakage or the pump failure by determining whether or not the leakage or the pump failure exists.

The control performed by the cooling controller 180 that determines presence or absence of the leakage or the pump failure is based on the flowchart as shown in FIG. 7. It is to be noted that the process up to determination of the leakage or the failure of the pump 111 from steps S201 to S205 as illustrated in the flowchart in FIG. 7 is similar to the steps S101 to S105 in FIG. 6 according to the first embodiment. Accordingly, the processes after Yes in S205 in which determination on whether or not the leakage or the failure of the pump 111 occurs has been made will now be described.

In the cooling device 110 according to the second embodiment, similar to the case of the first embodiment, if the leakage or the pump failure exists, even though a control to increase the airflow from each cooling fan 115*b* is performed (S204) when the detected temperature T exceeds the target temperature Tb (S203), the detected temperature T is not decreased to below the design temperature Tc. That is, the detected temperature T exceeds the design temperature Tc.

Then, in the present embodiment, if the detected temperature T is increased to exceed the design temperature Tc (Yes in step S205), in addition to a determination that the leakage or the failure of the pump 111 exists, following processing is performed to determine which of the leakage or the failure of the pump 111 occurs. If the detected temperature T exceeds the design temperature Tc (Yes in step S205), an operation mode is switched to increase the conveyance capacity of the coolant by the pump 111 (S206).

By thus increasing the conveyance capacity of the pump 111, when a certain amount of the coolant remains inside the coolant circulation passage 120, the heated portion is cooled to lower the detected temperature. However, if the pump 111 has failed, the detected temperature T is not decreased by cooling the heated portion. Focusing on the phenomenon above, the cooling device 110 of the present embodiment is configured to determine which of the leakage or the failure of the pump 111 occurs by the detected temperature T after the operation mode is switched to increase the conveyance amount of the coolant of the pump 111.

If the detected temperature T is decreased to a temperature below the design temperature Tc (T<Tc) after the operation mode change to increase the conveyance capacity of the pump 111 (S206), it is determined that a leakage occurs (Yes in step S207). Then, the "Error Code" indicating that "there is a possibility that the leakage occurs" and the "SC prompt" is displayed on the display of the copier 500 and the pump 111 is stopped (S208). After the stoppage of the pump 111, the cooling fan 115*b* of each heat releaser 115 is also stopped (S210). Further, a controller, not shown, of the copier 500 stops the successive image forming operation when the cooling device 110 is stopped as described above.

On the other hand, if the detected temperature T is higher than the design temperature Tc or does not decrease to below the design temperature Tc (NO in step S207), it is determined that a failure of the pump 111 occurs. Then, a communication with the main controller 560 of the copier 500 is performed, so that the "Error Code" indicating that "there is a possibility that the pump failure occurs" and the "SC prompt" prompting the user to contact the service center for repair are displayed on the display 570 of the copier 500 (S209). In addition, the cooling fan 115*b* of each heat releaser 115 is also stopped (S210). Further, the main controller 560 of the copier 500 stops the successive image forming operation when the cooling device 110 is stopped as described above.

An example of the actual control performed by the cooling controller 180 of the cooling device 110 is as follows. Herein, the cooling start temperature Ta, the target temperature Tb, and the design temperature Tc are respectively set to 25 degrees C., 35 degrees C., and 45 degrees C.

As described above, the process flow up to determination of the leakage or the failure of the pump 111 from steps S201 to S205 as illustrated in the flowchart of FIG. 7 is similar to the steps S101 to S105 in FIG. 6 according to the first embodiment. Accordingly, the process after the determination on whether or not the leakage or the failure of the pump 111 occurs has been performed will now be described referring to FIG. 7 as described above.

Then, even after the operation mode change in which the speed of the fan of the cooling fan 115*b* is changed to 3,000 rpm (S204), if the detected temperature T is increased and exceeds the design temperature Tc which is equal to 45 degrees C., it is determined that either the leakage or the failure of the pump 111 occurs (Yes in step S205). To increase the conveyance amount of the coolant performed by the pump 111, the operation mode is switched from the conveyance capacity of 0.5 L/min to that of 0.7 L/min (S206).

Thereafter, if the detected temperature T is decreased to a temperature lower than the design temperature Tc which is equal to 45 degrees C., it is determined that the leakage occurs (Yes in S207). Then, a communication with the main controller 560 of the copier 500 is performed, so that the "Error Code" indicating that "there is a possibility that the leakage occurs" and the "SC prompt" prompting the user to contact the service center for repair are displayed on the display 570 of the copier 500 and the pump 111 is stopped (S208). After the stoppage of the pump 111, the cooling fan 115*b* of each heat releaser 115 is also stopped (S210). Further, the main controller 560 of the copier 500 stops the successive image forming operation when the cooling device 110 is stopped as described above.

On the other hand, after the operation mode of the pump 111 is switched to the operation mode of 0.7 L/min (S206), the detected temperature T is not decreased and is higher than 45 degrees C., it is determined that the failure of the pump 111 occurs (NO in step S207) and following processing is performed. A communication with the main controller 560 of the copier 500 is performed, so that the "Error Code" indicating that "there is a possibility that the pump failure occurs" and the "SC prompt" prompting the user to contact the service center for repair are displayed on the display 570 of the copier 500 (S209). With this, the cooling fan 115*b* of each heat releaser 115 is caused to be stopped (S210). Further, the main controller 560 of the copier 500 stops the successive image forming operation when the cooling device 110 is stopped as described above.

As described above, the cooling device 110 according to the second embodiment includes the cooling controller 180 which determines whether or not the leakage or the pump failure exists by monitoring the control of the cooling fan 115*b* and the detected temperature T detected by the temperature sensor 118Bk similarly to the case of the first embodiment. In addition, the cooling device 110 includes a pump 111 capable of changing the conveyance capacity of the coolant or the operation mode based on the detected temperature T detected by the temperature sensor 118Bk and determines whether the leakage occurs or the pump 111 has failed by increasing the conveyance capacity. Specifically, by controlling the cooling fan 115*b* or increasing the speed of the fan, in correlating the change in the detected temperature of the temperature sensor 118Bk by changing the thermal capacity released from the heat releaser 115 with the change in the detected temperature of the temperature sensor 118Bk by increasing the conveyance capacity of the pump 111, the cooling device 110 can determine whether the leakage occurs or the pump failure occurs. Accordingly, even though the pump itself does not include any failure sensor so that the pump failure cannot be determined, or alternatively, even when the determination of the leakage is difficult, which of the leakage or the pump failure occurs can be determined. Then, the cooling device 110 communicates with the main controller 560 of the copier 500 to cause the "Error Code" of the leakage or the pump failure determined and the "SC prompt" to be displayed on the display 570 of the copier 500 and stops operation of the cooling device 110 so as to stop a successive image forming operation.

Then, the present invention provides the cooling device 110 which can detect the occurrence of the leakage or the pump failure more accurately than the conventional devices when the leakage of the liquid occurs or the pump has failed. Advantageously, the cooling device 110 of the present invention enables the copier 500 to be performed appropriately even when the leakage occurs or the pump has failed. Provision of the cooling device 110 provides the copier 500 capable of being operated appropriately even when the leakage occurs or the pump has failed.

When it is determined that the leakage or the pump failure occurs, a case in which the cooling device 110 is stopped and the successive image forming operation is stopped has been described heretofore. However, the present invention is not limited only to this. When the pump 111 has failed, even though the cooling device 110 is operated, a cooling effect cannot be obtained. In contrast, when the leakage occurs, the coolant is leaked in a certain amount, the cooling device 110 can be operated and the cooling effect can be obtained. The cooling device 110 of the second embodiment includes an operation mode (S206) in which the conveyance capacity of the pump 111 is increased when the detected temperature T exceeds the design temperature Tc in addition to the possibility to determine which of the leakage and the pump failure occurs.

Then, after the determination of leakage (Yes in step S207), without stopping the fan as in S208, the cooling device 110 is configured to continue an image forming operation tentatively while the detected temperature T is below the design temperature Tc. If the image forming operation is continued tentatively as above, in addition to the "Error Code" indicating that "there is a possibility that the leakage occurs" and the "SC prompt", a message for "Tentative operation" is displayed on the display 570 of the copier 500. Then, in an operation mode in which the speed of the cooling fan 115*b* is increased and the conveyance capacity of the coolant performed by the pump 111 is increased, the image forming operation is continued while the detected temperature T is below the design temperature Tc. Thus, by continuing the image formation so that the utilization rate of the copier 500 is improved even if only slightly, the convenience for the user may be improved.

In addition, similarly to the case of the first embodiment, it may be configured such that after the cooling device 110 is stopped and the successive image forming operation is stopped, the image forming operation restarts in a tentative fashion when the detected temperature T is decreased to below the cooling start temperature Ta or the target temperature Tb.

Figure 8:
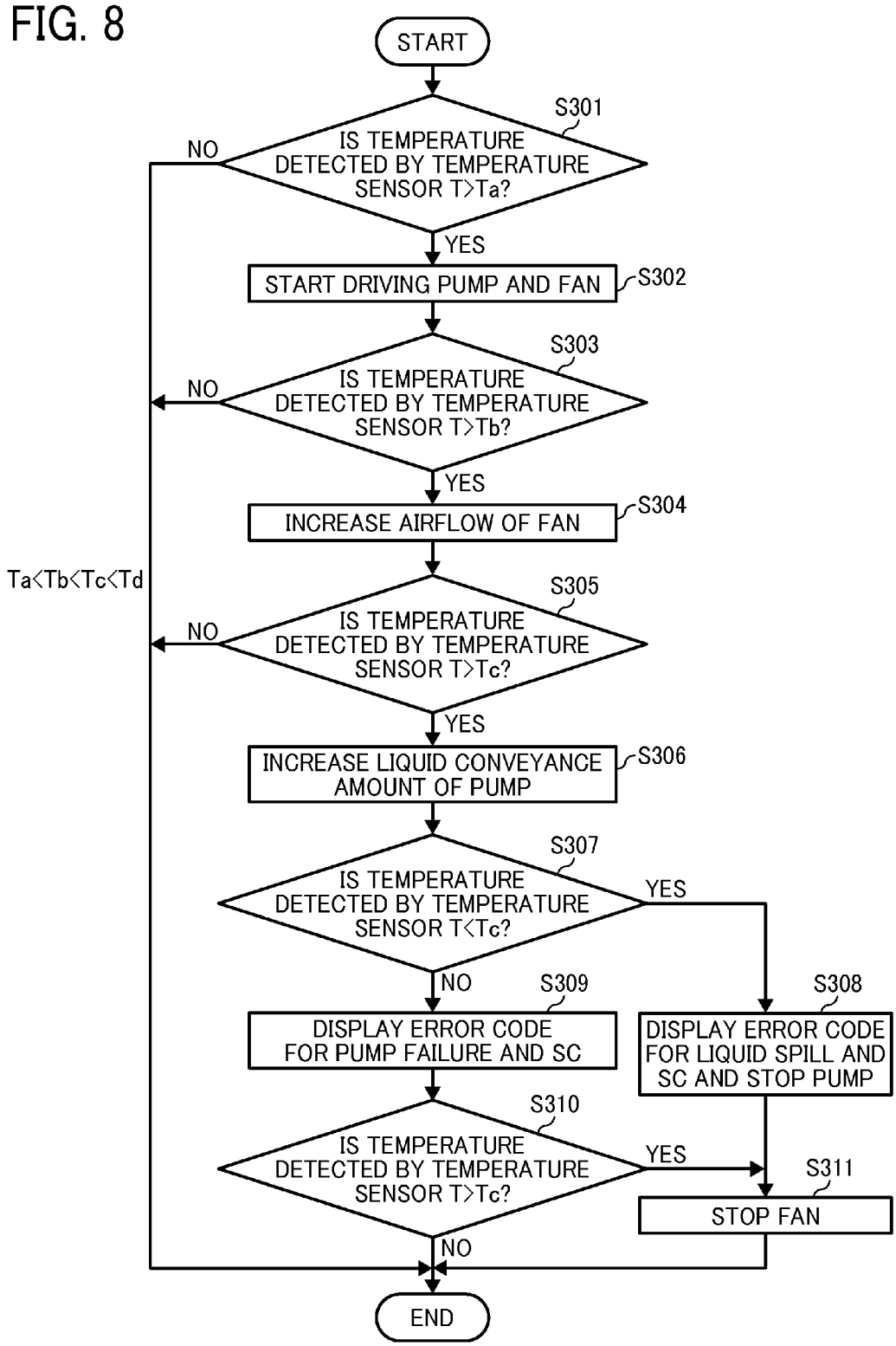
FIG. 8 is a flowchart depicting a control process executed by a cooling controller in determining presence or absence of a leakage or a pump failure according to a third embodiment of the present invention.
Figure 9:
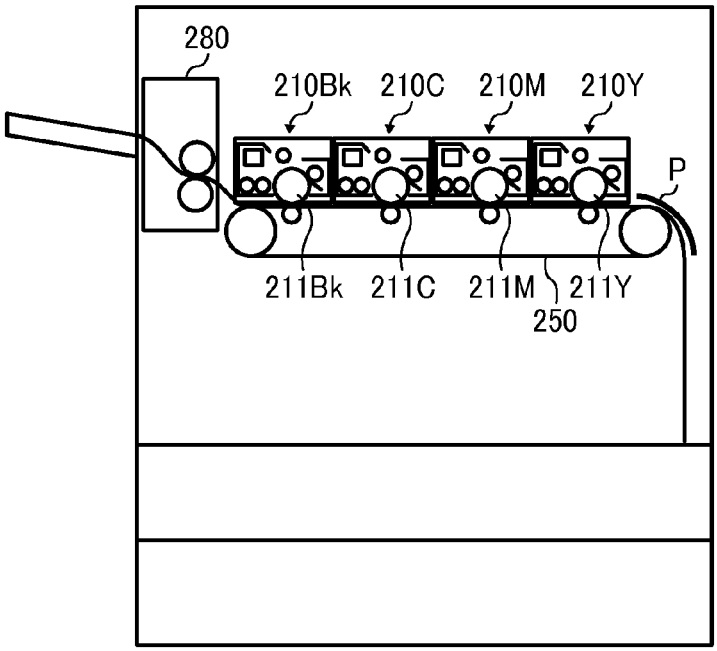
FIG. 9 PRIOR ART
FIG. 9 is an explanatory view of a conventional tandem-type image forming apparatus employing a direct transfer method.
Figure 10:
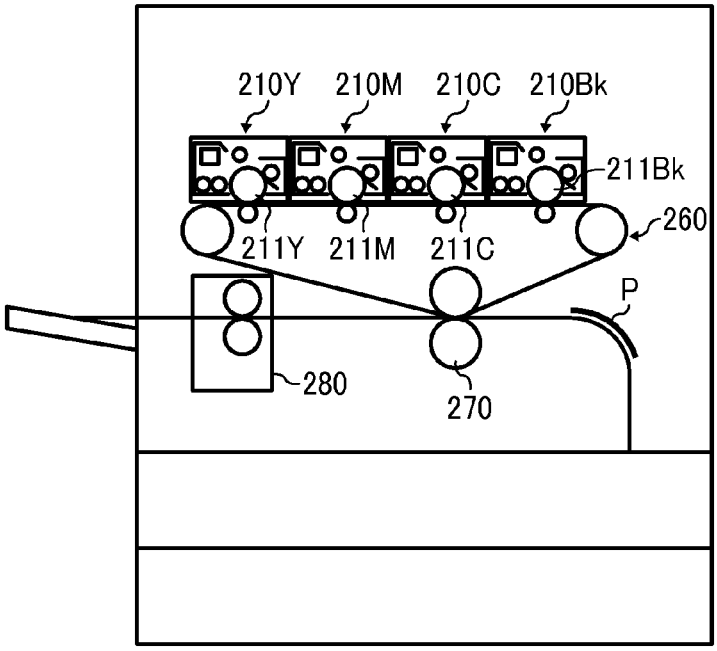
FIG. 10 PRIOR ART
FIG. 10 is an explanatory view of a conventional tandem-type image forming apparatus employing an indirect transfer method, in which each image forming unit is disposed above the intermediate transfer belt.
Figure 11:
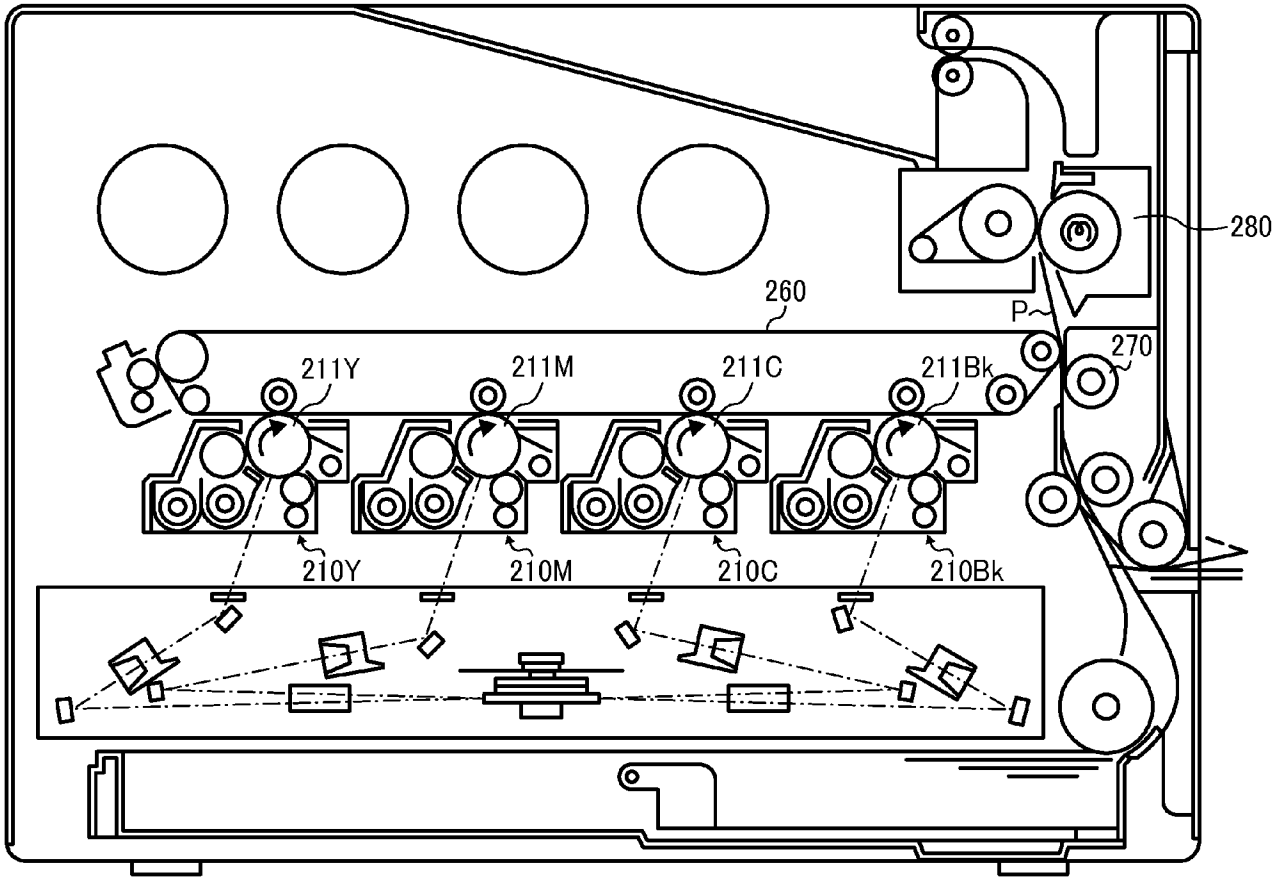
FIG. 11 PRIOR ART
FIG. 11 is an explanatory view of a conventional tandem-type image forming apparatus employing an intermediate transfer method, in which each image forming unit is disposed below the intermediate transfer belt.

Operation of a third embodiment of the cooling device 110 will now be described with reference to FIG. 8. The redundant explanation of the structure and operation of the cooling device similar to the second embodiment will be appropriately omitted in the following description. FIG. 8 is a flowchart depicting a control process executed by the cooling controller 180 in determining presence or absence of a leakage or a pump failure according to the third embodiment of the present invention.

The control performed by the cooling controller 180 in determining presence or absence of the leakage or the pump failure according to the third embodiment is different from the second embodiment in a post processing after the determination of the occurrence of the pump failure. Accordingly, the structure similar to the second embodiment will be appropriately omitted in the following description.

Similarly to the second embodiment, the cooling device 110 according to the third embodiment includes the heat receiver 112Bk closely contacted to the side wall of the developing device 70Bk which is the part that heats up the most and the temperature sensor 118Bk disposed at the heat receiver 112Bk as illustrated in FIG. 4. In addition, as a pump to convey the coolant to be circulated in the coolant circulation passage 120, the pump 111 capable of changing its conveyance capacity of the coolant is disposed. Then, the cooling fan 115*b* of the heat releaser 115 is controlled based on the temperature detected by the temperature sensor 118Bk, and the cooling controller 180 which determines whether or not the leakage or the pump failure exists detects the leakage or the pump failure by determining whether or not the leakage or the pump failure exists.

The control performed by the cooling controller 180 that determines presence or absence of the leakage or the pump failure is based on the flowchart as shown in FIG. 8.

Further, the process flow up to determination on the leakage or the failure of the pump 111 from steps S301 to S305 as illustrated in the flowchart in FIG. 8 is similar to the steps S201 to S275 in FIG. 7 according to the second embodiment. Accordingly, the processes after Yes in S305 in which determination on whether or not the leakage or the failure of the pump 111 occurs has been made will now be described.

Similarly to the second embodiment, the cooling device 110 of the third embodiment is configured to determine which of the leakage and the failure of the pump 111 occurs (in S307) as follows. Even though an airflow amount of each cooling fan 115*b* is increased (S304), if the detected temperature T is increased to exceed the design temperature Tc (Yes in step S305), the operation mode is changed to the mode in which the conveyance capacity of the pump 111 is increased (S306), and whether the leakage or the failure of the pump 111 occurs is determined (S307).

If the detected temperature T is decreased to a temperature lower than the design temperature Tc after the operation mode change to increase the conveyance capacity of the pump 111 (S306), it is determined that a leakage occurs (Yes in step S307). Then, similarly to the second embodiment, a communication with the main controller 560 of the copier 500 is performed, so that the "Error Code" indicating that "there is a possibility that the leakage occurs" and the "SC prompt" prompting the user to contact the service center for repair are displayed on the display 560 of the copier 500 and the pump 111 is stopped (S308). After the stoppage of the pump 111, the cooling fan 115*b* of each heat releaser 115 is also stopped (S311). Further, the main controller 560 of the copier 500 stops the successive image forming operation when the cooling device 110 is stopped as described above.

On the other hand, if the detected temperature T is higher than the design temperature Tc, it is determined that a failure of the pump 111 occurs (NO in step S307). Then, a communication with the main controller 560 of the copier 500 is performed, so that the "Error Code" indicating that "there is a possibility that the pump failure occurs" and the "SC prompt" prompting the user to contact the service center for repair are displayed on the display 570 of the copier 500 (S309). Differently from the second embodiment, the cooling device 110 according to the third embodiment determines whether or not the detected temperature T increases beyond a previously set design maximum temperature Td (Ta<Tb<Tc<Td) (in step S310) after displaying the above messages.

If the detected temperature T is increased to exceed the design temperature Tc and continues to be increased further, there occurs such disadvantages as occurrence of an abnormal image due to the toner agglomeration and the like, and the deformation of the resinous materials used in the developing device 70 leading to the need of replacing parts other than the pump 111. Then, the cooling device 110 according to the third embodiment has set the design maximum temperature Td with a predetermined allowance so that any disadvantage necessitating the replacement of the parts other than the pump 111 can be obviated.

If the detected temperature T is below the design maximum temperature Td, the image forming operation is tentatively continued (No in step S310). If the image forming operation is continued tentatively as above, in addition to the "Error Code" indicating that "there is a possibility that the pump failure occurs" and the "SC prompt", a message for "Tentative operation" is displayed on the display 570 of the copier 500.

On the other hand, if the detected temperature T exceeds the design maximum temperature Td (Yes in step S310), the cooling fan 115*b* of each heat releaser 115 also stops (S311). Further, the main controller 560 of the copier 500 stops the successive image forming operation when the cooling device 110 is stopped as described above.

An example of the actual control performed by the cooling controller 180 of the cooling device 110 is as follows. Herein, the cooling start temperature Ta, the target temperature Tb, and the design temperature Tc are respectively set to 25 degrees C., 35 degrees C., and 45 degrees C. Then, the design maximum temperature Td is set to 48 degrees C.

Further, the process flow up to the determination on the leakage or the failure of the pump 111 from steps S301 to S307 as illustrated in the flowchart in FIG. 8 is similar to the steps S201 to S207 in FIG. 7 according to the second embodiment. Accordingly, the processes after the determination on whether or not the leakage or the failure of the pump 111 occurs (Yes in step S305) has been performed will now be described referring to FIG. 8 as described above.

Then, even after the operation mode change in which the speed of the fan of the cooling fan 115*b* is changed to 3,000 rpm (S304), if the detected temperature T is increased and exceeds the design temperature Tc which is equal to 45 degrees C., it is determined that either the leakage or the failure of the pump 111 occurs (Yes in step S305). Then, the operation mode of the pump 111 is changed from 0.5 L/min to 0.7 L/min in order to increase the conveyance amount of the coolant (S306). After the operation mode of the pump 111 is switched to 0.7 L/min (S306), if the detected temperature T by the temperature sensor 118Bk is decreased to below 45 degrees C. which is the design temperature Tc, it is determined that the leakage occurs (Yes in step S307). Then, a communication with the main controller 560 of the copier 500 is performed, so that the "Error Code" indicating that "there is a possibility that the leakage occurs" and the "SC prompt" prompting the user to contact the service center for repair are displayed on the display 570 of the copier 500 and the pump 111 is stopped (S308). Upon stoppage of the pump 111, the cooling fan 115*b* of each heat releaser 115 is also stopped (S311). Further, the main controller 560 of the copier 500 stops the successive image forming operation when the cooling device 110 is stopped as described above.

By contrast, after the operation mode change of the pump 111 to 0.7 L/min (S306), if the detected temperature T is not decreased and is more than 45 degrees C., it is determined that the failure of the pump 111 occurs (No in step S307), and following processing is performed. A communication with the main controller 560 of the copier 500 is performed, so that the "Error Code" indicating that "there is a possibility that the pump failure occurs" and the "SC prompt" prompting the user to contact the service center for repair are displayed on the display 570 of the copier 500 (S309) and a determination on whether the detected temperature T exceeds or not the design maximum temperature Td which is equal to 48 degrees C. is made (S310).

If the detected temperature T is below the design maximum temperature Td which equals 48 degrees C., the image forming operation is tentatively continued (No in step S310). Then, a communication with the main controller 560 of the copier 500 is performed, so that "Error Code" indicating that "there is a possibility that the pump failure occurs," "SC prompt" prompting the user to contact the service center for repair, and a message indicating "Tentative operation" are displayed on the display 570 of the copier 500.

On the other hand, if the detected temperature T exceeds the design maximum temperature Td (Yes in step S310), the cooling fan 115*b* of each heat releaser 115 also stops (S311). Further, the main controller 560 of the copier 500 stops the successive image forming operation when the cooling device 110 is stopped as described above.

As described above, the phenomenon when the leakage of the pump failure occurs is focused and it can be determined identically to the second embodiment which of the leakage and the pump failure occurs. Accordingly, even though the pump itself does not include any failure sensor so that the pump failure cannot be determined, or alternatively, even when the determination of the leakage is difficult, which of the leakage and the pump failure occurs can be determined. Accordingly, the leakage or the pump failure can be detected more accurately compared to the conventional devices. Then, the main controller 560 of the copier 500 causes the "Error Code" of the leakage or the pump failure determined and the "SC prompt" prompting a user to contact the service center to be displayed on the display 570 of the copier 500 and following measures may be taken.

If it is determined that the leakage occurs, the cooling device 110 communicates with the main controller 560 of the copier 500 to cause the "Error Code" of the leakage or the pump failure determined and the "SC prompt" to be displayed on the display 570 of the copier 500 and stops operation of the cooling device 110 so as to stop a successive image forming operation. On the other hand, if it is determined that the pump 111 has failed, the cooling fan 115*b* is not stopped until the detected temperature T exceeds the design maximum temperature Td and the tentative image forming operation is continued. Thus, by continuing the image formation so that the utilization rate of the copier 500 is improved even if only slightly, the convenience for the user may be improved.

Then, the present invention provides the cooling device 110 which can detect the occurrence of the leakage or the pump failure more accurately than the conventional devices when the leakage of the liquid occurs or the pump has failed. Advantageously, the cooling device 110 of the present invention enables the copier 500 to be performed appropriately even when the leakage occurs or the pump has failed. Provision of the cooling device 110 provides the copier 500 capable of being operated appropriately even when the leakage occurs or the pump has failed.

When it is determined that the leakage or the pump failure occurs, a case in which the cooling device 110 is stopped and the successive image forming operation is stopped has been described heretofore. However, the present invention is not limited only to this. Similarly to the second embodiment, after the determination of leakage (Yes in step S207), without stopping the fan as in S308, the cooling device 110 is configured to continue an image forming operation tentatively while the detected temperature T is below the design temperature Tc. If the image forming operation is resumed tentatively as above, in addition to the "Error Code" indicating that "there is a possibility that the leakage occurs" and the "SC prompt", a message for "Tentative operation" is displayed on the display 570 of the copier 500. Then, in an operation mode in which the speed of the cooling fan 115*b* is increased and the conveyance capacity of the coolant performed by the pump 111 is increased, the image forming operation is continued while the detected temperature T is below the design temperature Tc. Thus, by continuing the image formation so that the utilization rate of the copier 500 is improved even if only slightly, the convenience for the user may be improved.

In addition, similarly to the second embodiment, it may be configured such that after the cooling device 111 is stopped and the successive image forming operation is stopped, the image forming operation restarts in a tentative fashion when the detected temperature T is decreased to below the cooling start temperature Ta or the target temperature Tb.

It is thought that the temperature of a portion where the activation ratio is highest and which is most heated becomes highest, and therefore, the heat receiver 112Bk closely contacted to the side wall of the developing device 70Bk which is the part that heats up the most is provided with the temperature sensor 118Bk in each embodiment of the present invention. However, the present invention is not limited to this structure. For example, a sensor 118 is disposed to each heat receiver 112 and the cooling device 110 is controlled based on the highest detected temperature T.

In addition, a case has been described in which when the detected temperature T is below the cooling start temperature Ta, the operation mode is switched to the operation mode in which the pump 111 and the cooling fan 115*b* are stopped.

However, the present invention is not limited to such a structure only, and for example, the cooling device 110 of the present invention can be configured such that even when the detected temperature T is below the cooling start temperature Ta, the pump 111 is operated to obtain a predetermined conveyance capacity of the coolant.

In addition, an example in which after switching to the operation mode in which the pump 111 and the cooling fan 115*b* are operated when the detected temperature T exceeds the cooling start temperature Ta, the speed or airflow amount of the cooling fan 115*b* is constant until the detected temperature T reaches the target temperature Tb. However, the present invention is not limited to such a structure. For example, it can be configured such that the airflow amount of the cooling fan 115*b* is increased at a plurality of stages based on the detected temperature T.

In addition, controlling of the cooling fan 115*b* based on the detected temperature T is performed by switching the operation mode of the cooling fan 115*b* among stoppage or operation and switching the speed of the fan. However, the present invention is not limited only to this. For example, not by switching the speed of the fan, the number of cooling fans 115*b* to be stopped or operated among the cooling fans 115*b* disposed at the plurality of heat releasers 115 is changed and the total amount of the thermal capacity of the heat radiated from each heat releaser 115 per unit time is switched so as to control the cooling fan 115*b*. In addition, by switching the operation period of time of the cooling fan 115*b* in a predetermined time interval, the thermal capacity of the heat radiated from the heat releaser 115 is switched and controlled.

Specifically, as far as the structure is controllable by switching the total amount of the thermal capacity per unit time to be released from the single or plural heat releaser 115, the target for controlling may be the speed of the fan, operation or stoppage of the cooling fan 115*b*, and the continued operation period of time, or a combination of the above. The above may be arbitrarily selected and configured depending on the design conditions such as use, method, size, electrical consumption, production cost, and the number of control steps of the image forming apparatus employing the cooling device 110 according to the embodiment of the present invention.

Further, in the present embodiment, the cooling device 110 capable of reducing the temperature rise in the developing device 70 has been described, but the present invention is not limited only to such a structure. For example, the heat receiver 112 can be configured to contact the temperature rising part other than the developing device 70, such as the scanner 300, the fixing device 60, or the conveyance guide 68. Further, the heat receiver 112 can be integrally formed with any cooled part not limited to the structure to contact the cooled part.

According to the present invention, the cooling fan is optimally controlled based on the temperature detected by the temperature sensor and the thermal capacity radiated from the heater is changed, so that the detected temperature becomes below the predetermined temperature when the leakage of the liquid or the pump failure does not occur.

When the leakage or the pump failure exists, the thermal capacity cannot be radiated from the heater even though the cooling fan is controlled such that the detected temperature becomes below the predetermined temperature when the leakage or the pump failure does not occur. As a result, a phenomenon such that he detected temperature of the temperature sensor does not decrease to less than the predetermined temperature occurs.

Focusing on this phenomenon, by monitoring the control of the cooling fan and the detected temperature of the temperature sensor, the presence or absence of the liquid spill and the pump failure can be determined. More specifically, the cooling fan is controlled such that the detected temperature becomes below the predetermined temperature if the liquid spill or the pump failure does not exist, and when the detected temperature of the temperature sensor becomes below the predetermined temperature, it can be determined that the liquid spill or the pump failure does not exist. On the other hand, if the detected temperature does not decrease to below the predetermined temperature, it is determined that the liquid spill or the pump failure exists.

As described above, presence or absence of the leakage or the pump failure is determined, whereby even when the pump itself does not include the failure sensor to detect the pump failure and the determination on the leakage by the remaining amount sensor is impossible, presence or absence of the liquid spill or the pump failure can be determined so that the leakage or the pump failure can be more accurately detected than in the background art.

Additional modifications and variations of the present invention are possible in light of the above teachings. It is therefore to be understood that, within the scope of the appended claims, the invention may be practiced other than as specifically described herein.

What is claimed is:

1. A cooling device for an image forming apparatus, comprising:

a heat receiver disposed to contact a heated member;

a heat releaser to release heat;

a coolant circulation passage connecting the heat receiver and the heat releaser, in which a coolant circulates between the heat receiver and the heat releaser;

a pump disposed on the coolant circulation passage and configured to convey and circulate the coolant in the coolant circulation passage;

a temperature sensor to detect a temperature of the heated member;

a cooling fan, included in the heat releaser, configured to change a thermal capacity released from the heat releaser based on a temperature detected by the temperature sensor; and a controller to determine presence or absence of a leakage of a liquid or a pump failure by monitoring control performed by the cooling fan and the temperature detected by the temperature sensor.

2. The cooling device as claimed in claim 1, wherein the control performed by the cooling fan includes operation or stoppage of the cooling fan and switching of a speed of the fan.

3. The cooling device as claimed in claim 1, further comprising a display, wherein an airflow amount of the cooling fan is increased when the temperature detected by the temperature sensor exceeds a predetermined temperature and an error message is displayed when the temperature detected by the temperature sensor does not decrease after the airflow amount of the cooling fan is increased.

4. The cooling device as claimed in claim 1, wherein the pump is configured to switch the conveyance capacity of the coolant to be circulated in the coolant circulation passage based on the temperature detected by the sensor.

5. The cooling device as claimed in claim 3, wherein, when the pump and the cooling fan are stopped, operation by the image forming apparatus is stopped.

6. The cooling device as claimed in claim 5, wherein, after the cooling device is stopped and operation of the image forming apparatus is stopped, operation is tentatively restarted when the temperature detected by the temperature sensor is decreased to below a cooling start temperature Ta or a target temperature Tb.

7. The cooling device as claimed in claim 3, wherein the airflow amount of the cooling fan is increased when the temperature detected by the temperature sensor exceeds a predetermined temperature, and the conveyance capacity of the coolant by the pump is increased when the temperature detected by the temperature sensor does not decrease after the airflow amount of the cooling fan is increased.

8. The cooling device as claimed in claim 7, wherein, if the temperature detected by the temperature sensor is decreased after an operation mode change to increase the conveyance capacity of the pump, it is determined that a leakage occurs and an error message is displayed on the display.

9. The cooling device as claimed in claim 7, wherein, if the temperature detected by the temperature sensor does not decrease after the operation mode change to increase the conveyance capacity of the pump, it is determined that a pump failure occurs and an error message is displayed on the display.

10. The cooling device as claimed in claim 9, wherein, when the temperature detected by the temperature sensor is not further increased after the error message has been displayed, the image forming operation is tentatively continued.

11. The cooling device as claimed in claim 9, wherein, when the temperature detected by the temperature sensor is further increased after the error message has been displayed, the cooling fan is stopped.

12. The cooling device as claimed in claim 9, wherein, when the cooling fan is stopped, operation of the image forming apparatus is stopped.

13. An image forming apparatus comprising the cooling device as claimed in claim 1.

14. The image forming apparatus of claim 13, configured to operate by monitoring a control of the cooling fan or the control of the cooling fan and the conveyance capacity of the pump, and the temperature detected by the temperature sensor.

* * * * *